US009482462B2

(12) United States Patent
Beilfuss

(10) Patent No.: US 9,482,462 B2
(45) Date of Patent: Nov. 1, 2016

(54) SYSTEMS AND METHODS FOR PROVIDING TWO ENERGY LEVEL SETTINGS FOR A REFRIGERATOR HOT WATER HEATER

(71) Applicant: General Electric Company, Schenectady, NY (US)

(72) Inventor: Robert Charles Beilfuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 506 days.

(21) Appl. No.: 13/925,944

(22) Filed: Jun. 25, 2013

(65) Prior Publication Data

US 2014/0374061 A1 Dec. 25, 2014

(51) Int. Cl.
*F25D 21/08* (2006.01)
*F25D 23/12* (2006.01)

(52) U.S. Cl.
CPC ..... *F25D 21/08* (2013.01); *F25D 23/12* (2013.01); *F25D 2400/02* (2013.01)

(58) Field of Classification Search
CPC ..... F25D 21/08; F25D 21/002; F25D 23/12; F25D 2400/02
See application file for complete search history.

(56) References Cited

U.S. PATENT DOCUMENTS 3,381,226 A * 4/1968 Jones ..... H01H 33/593 219/501
4,213,313 A * 7/1980 Kiefer ..... A47L 15/46 134/58 D
5,737,232 A * 4/1998 Wetekamp ..... H02J 3/16 700/286
7,047,754 B2 * 5/2006 An ..... F25D 23/126 62/150
8,291,718 B2 * 10/2012 Junge ..... F25D 21/006 62/80
2003/0182958 A1 * 10/2003 Gray ..... F25D 29/00 62/229
2005/0121438 A1 * 6/2005 Hirota ..... H05B 6/062 219/663
2006/0260335 A1 * 11/2006 Montuoro ..... F25B 49/02 62/236

(Continued)

FOREIGN PATENT DOCUMENTS

GB 1 347 627 A 2/1974

OTHER PUBLICATIONS

Poko TD-169C Hair Dryer Circuit Diagram, Published Aug. 19, 2011.

*Primary Examiner* — Len Tran
*Assistant Examiner* — Kun Kai Ma
(74) *Attorney, Agent, or Firm* — Dority & Manning, P.A.

(57) ABSTRACT

Systems and methods for providing two energy level settings for a refrigerator hot water heater are provided. An exemplary refrigerator includes a refrigeration system that includes an evaporator. The refrigerator includes a defrost assembly for defrosting one or more of the evaporator or a freezer compartment. The refrigerator includes a water dispensing assembly that includes a heating element for heating a volume of water. The refrigerator includes a controller configured to operate the heating element at a first energy level when the defrost assembly is not operating and to operate the heating element at a second energy level when the defrost assembly is operating. An exemplary method includes detecting that the refrigerator is performing an energy critical task. The method includes enabling a reduced consumption of electrical power by a heating element included in a water dispensing assembly of the refrigerator when the refrigerator is performing the energy critical task.

16 Claims, 9 Drawing Sheets

(56) References Cited

U.S. PATENT DOCUMENTS

2007/0023451 A1* 2/2007 Bordino ..... B67D 3/0022 222/146.5
2011/0185755 A1* 8/2011 Kim ..... F25D 21/08 62/155
2011/0289949 A1* 12/2011 Bai ..... F25C 5/005 62/159
2012/0237190 A1* 9/2012 Li ..... A47J 31/56 392/451
2013/0025303 A1* 1/2013 Yoon ..... F25B 49/022 62/89

* cited by examiner

SYSTEMS AND METHODS FOR PROVIDING TWO ENERGY LEVEL SETTINGS FOR A REFRIGERATOR HOT WATER HEATER

The present disclosure relates generally to refrigerators. More particularly, the present disclosure relates to systems and methods for providing two energy level settings for a refrigerator hot water heater.

BACKGROUND OF THE INVENTION

Recent advances in consumer appliances have provided additional features to refrigerators which enhance efficiency, ease of use, practicality, or other factors that increase user satisfaction.

As an example, certain refrigerators have recently been designed to provide the option of hot water from a water dispensing system. For example, a refrigerator water dispensing system can include a tank for holding a volume of water and a heating element can be operated to heat the volume of water prior to dispensing the water to the user. More complex implementations, such as instant water heating or on-demand water heating, are available as well.

Most refrigerators also include an evaporator that normally operates at sub-freezing temperatures in a compartment positioned behind the freezer compartment. A layer of frost typically builds up on the surface or coils of the evaporator. Defrost cycles are needed in order to melt any frost or ice that forms or builds upon on the refrigeration coils of the evaporator in a refrigeration system. Typical defrost systems utilize defrost heaters or defrosting elements to melt the ice buildup.

The defrost heater may be similar to the heating elements on an electric stove and can be generally located near or beneath the cooling coils, which are concealed behind a panel in the refrigeration or freezer compartment. During the defrost cycle, the defrost heater gets hot. As a result of its proximity to the cooling coils, any ice or frost build-up on the coils melts. A radiant heater is often positioned inside a housing and below the evaporator to warm the evaporator by both convection and radiant heating in order to quickly defrost the evaporator.

Once a defrost cycle is initiated, it is important to not interrupt the defrost cycle or otherwise cause the defrosting element to lose sufficient power until all of the frost or ice buildup has melted. If the defrost cycle is interrupted while there is still a mixture of frost and water on the evaporator, this mixture will have a tendency to refreeze into solid ice. It is much more difficult to remove solid ice from an evaporator than frost.

Frost tends to be more evenly distributed than solid ice and is less likely to eventually completely insulate the evaporator and reduce or block airflow. Blocked airflow will result in a service call due to lack of cooling. Therefore, an incomplete or interrupted defrost cycle can result in an ice-clogged evaporator.

Thus, a challenge presented by the increasing inclusion of additional features in a refrigerator, such as a water dispensing system that offers heated water, is balancing energy demands from each of such features. In particular, once a defrost cycle has begun, it is important to provide sufficient energy to the defrosting element so that defrosting is properly performed and solid ice is not permitted to form on the evaporator.

Therefore, a refrigerator hot water heater having two energy level settings is desirable.

BRIEF DESCRIPTION OF THE INVENTION

Additional aspects and advantages of the invention will be set forth in part in the following description, or may be apparent from the description, or may be learned through practice of the invention.

One aspect of the present disclosure is directed to a refrigerator. The refrigerator includes a refrigeration system that includes an evaporator. The refrigerator includes a defrost assembly for defrosting one or more of the evaporator or a freezer compartment. The refrigerator includes a water dispensing assembly that includes a heating element for heating a volume of water. The refrigerator includes a controller configured to operate the heating element at a first energy level when the defrost assembly is not operating and to operate the heating element at a second energy level when the defrost assembly is operating.

Another aspect of the present disclosure is directed to a refrigerator control circuit included in a refrigerator that has a water dispensing system that includes a heating element. The refrigerator also has a defrosting element operable to defrost an evaporator of the refrigerator. The refrigerator control circuit includes a control unit including a processor and a memory. The refrigerator control circuit includes an AC connection for receiving AC power from an AC power supply. The refrigerator control circuit includes a power level control circuit electrically connected between the AC connection and the heating element. The control unit controls the power level control circuit to provide a first level of power to the heating element when the defrosting element is not operating and to provide a second level of power to the heating element when the defrosting element is operating. The first level is greater than the second level.

Another aspect of the present disclosure is directed to a method for operating a refrigerator. The method includes connecting a standard supply of electrical power to a heating element included in a water dispensing assembly of the refrigerator. The method includes detecting that the refrigerator is performing an energy critical task. The method also includes enabling a reduced consumption of electrical power by the heating element when the refrigerator is performing the energy critical task.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
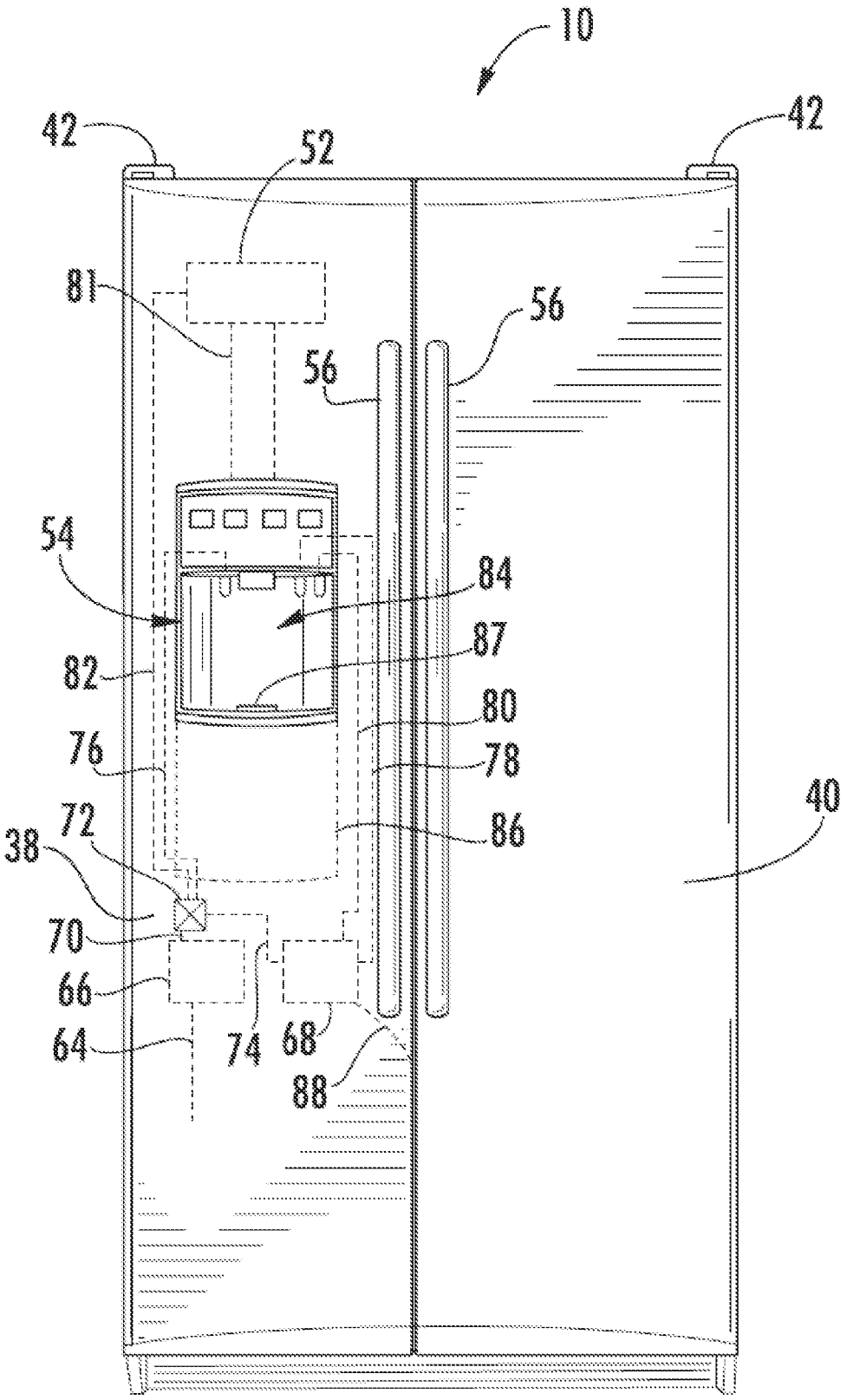
FIG. 1 provides a front view of an exemplary refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally the present disclosure is directed to systems and methods for providing two energy level settings for a refrigerator hot water heater. In particular, a refrigerator control unit can monitor whether an energy critical task, such as operation of a defrosting assembly to defrost the refrigerator evaporator, is currently being performed. When such an energy critical task is being performed, the control unit can control a power level control circuit to reduce the power applied to or consumed by a heating element of the hot water heater. In such fashion, the competing energy demands of various refrigerator features can be managed such that the energy critical task is successfully performed.

With reference now to the FIGS., exemplary embodiments of the present disclosure will now be discussed in detail. FIG. 1 is a perspective view of an exemplary refrigeration appliance 10 depicted as a side by side refrigerator in which dispenser structures in accordance with aspects of the present disclosure may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Figure 2:
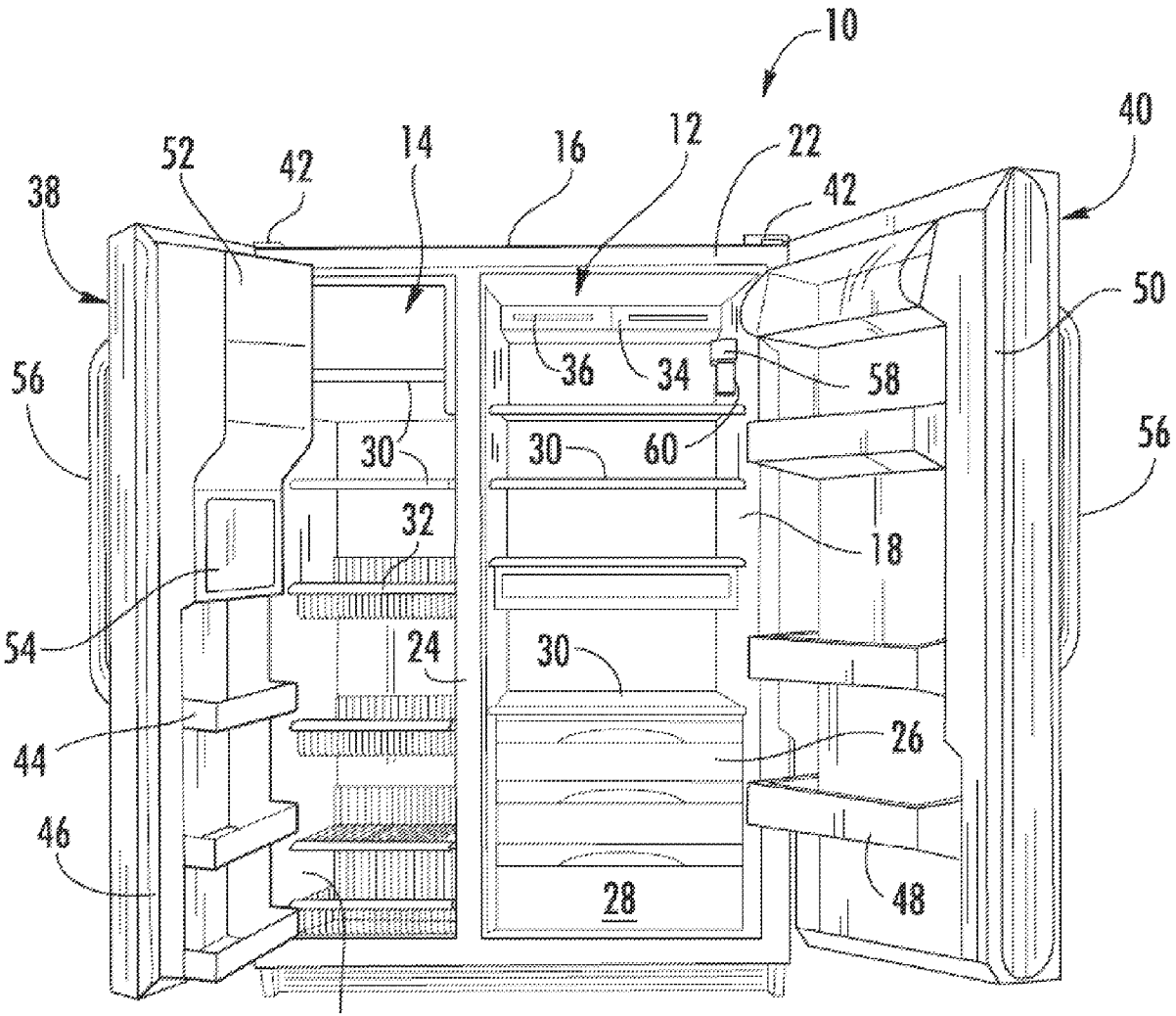
FIG. 2 provides a front view of the exemplary refrigeration appliance of FIG. 1 with its doors opened.

Referring now to FIG. 2, the refrigerator 10 comprises a refrigerated cabinet including a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 can also be provided in freezer storage compartment 14.

The refrigerator features can be controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54, although filter 60 may be located in other locations, such as within one of doors 38 or 40.

As with known refrigerators, the refrigerator 10 also includes a machinery compartment 63 (see FIG. 3) that at least partially contains components of refrigeration equipment 65 for executing a known vapor compression cycle for cooling air.

Figure 3:
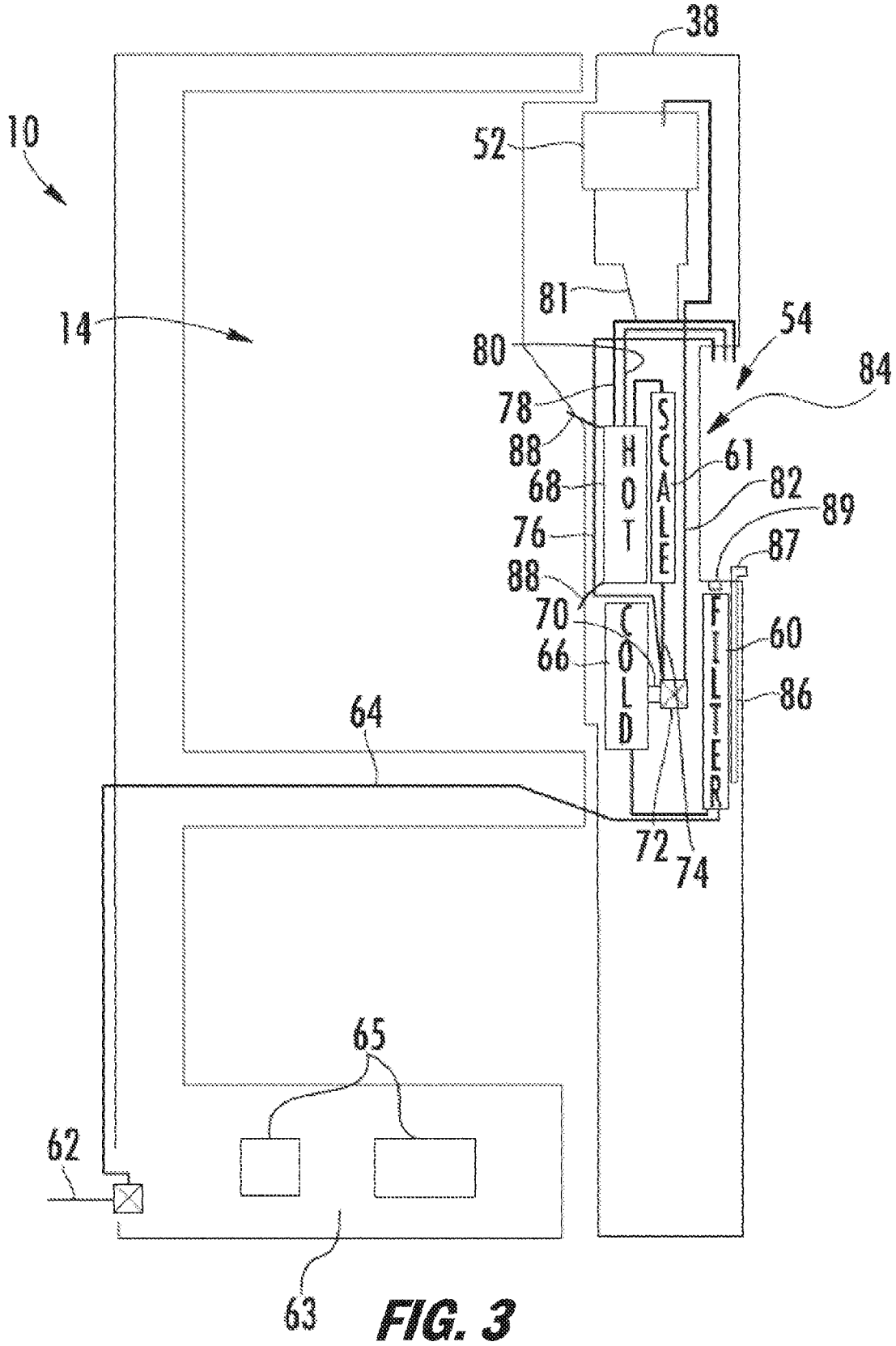
FIG. 3 provides a diagrammatical side view of the exemplary refrigeration appliance of FIG. 1, showing a water system according to certain aspects of the disclosure.

Referring now to FIG. 3, refrigeration appliance 10 comprises a refrigerated cabinet including a cooled storage compartment, in this case freezer compartment 14. Door 38 closes compartment 14, with dispenser 54 in an outer surface of the door. A water supply 62 is provided with an inlet portion 64 in communication with a cold water storage tank 66. Water supply 62 is at premises line pressure which can vary, for example, between about 20 and 120 psig. Typical premises line pressures are in the range of about 60 psig.

As shown, tank 66 is within door 38. Filter 60 is shown as within door 38 between inlet portion 64 and cold water storage tank 66 as well, but could be within the refrigeration appliance case, if desired. Also shown within door 38 is an ice maker 52. It should be understood that this elements could be located elsewhere as well. An optional anti-scaling device 61 could also be provided in the system if desired, in particular if water heating is to be performed.

Also shown within door 38 is a hot water storage tank 68. Hot water tank 68 may include a heating element located within a tank body. The tank body portions may be made of a plastic such as polyethersulfone and the like, and the portions may be connected by ultrasonic, thermal welding, etc. A metallic liner may be provided to shield the tank body portions from the heating element.

The heating element can be an electrical resistance heating device, a microwave heating device, an induction heating device, or any other suitable heating element for heating the water contained within hot water tank 68. Further, it will be appreciated that other heating elements can be included within the water dispensing system at various locations in addition to or alternatively to a heating element included in hot water storage tank 68. Each of such heating elements can optionally be controlled or energized by controller 34.

As to valving and routing of flow, if desired, cold water storage tank 66 may have an outlet 70 in communication with valving 72 to divide flow from the cold water storage tank into at least two flows: a first of the two flows being directed via a conduit 74 to hot water storage tank 68, a second of the two flows being directed via a conduit 76 to dispenser 54 for dispensing chilled water Conduit 78 places hot water tank 68 in communication with dispenser 54 for dispensing hot water, while optional conduit 80 does so for dispensing steam (for cleaning purposes). Valving 72 can also divide the flow from cold water storage tank 66 into a third flow which is directed via conduit 82 to ice maker 52. Ice bucket passage 81 allows ice cubes to be dispensed though dispenser 54. Accordingly, if all such functionality is provided, hot water, cold water, ice cubes and steam may be dispensed in dispenser 54, although all such items need not be used in any given application.

If desired, dispenser 54 may be cleanable via steam. If so, interior area 84 can be coverable by a slidable or pivotable cover 86 having a handle 87. Steam can thus be provided via conduit 80 to the dispenser interior area 84 for cleaning when the interior area is covered by cover 86. For safety purposes, a sensor 89 can be provided to sense whether cover 86 is in a closed position, whereby the steam function is disabled by controller 34 unless the sensor senses that the cover is in the closed position.

It may be desired to assist in removal of heat from hot water storage tank 68, to reduce energy required to chill the refrigeration appliance in general. Accordingly, a heat transfer element 88 may be provided (schematically shown in FIG. 3) for removing heat generated by the heating device in the tank 68. Element 88 may be at least one of a metallic tape or a foil adhesive for moving heat to the mullion or other exterior area of refrigerated appliance 10. If tank 68 is located in a door, the door mullion area 24 would be a likely location for the element to draw heat toward for exiting into the environment.

Figure 4:
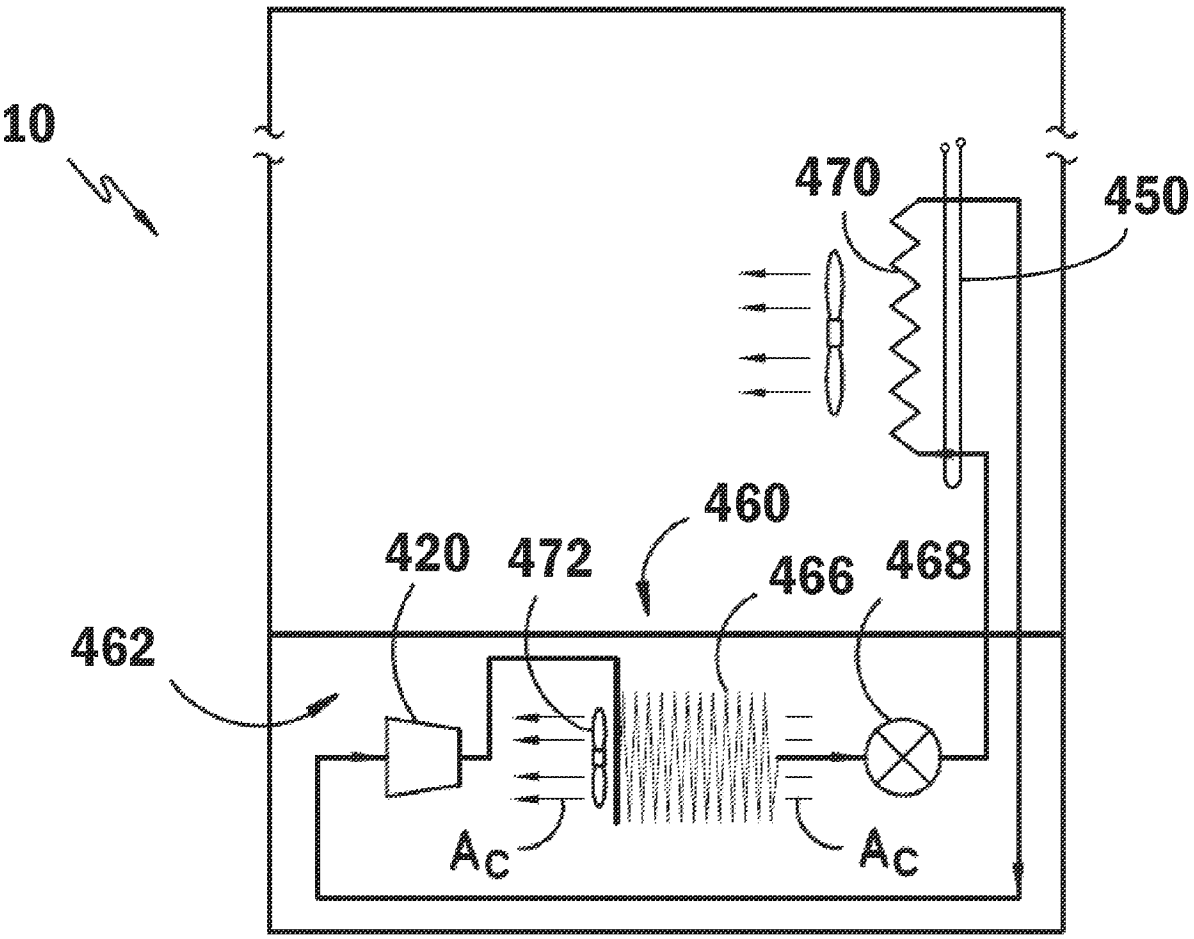
FIG. 4 provides a schematic view of a refrigeration system of the exemplary refrigerator appliance of FIG. 1.

FIG. 4 is a schematic view of refrigerator appliance 10 including an exemplary sealed refrigeration system 460. A machinery compartment 462 contains components for executing a known vapor compression cycle for cooling air. The components include a compressor 420, a condenser 466, an expansion device 468, and an evaporator 470 connected in series and charged with a refrigerant. As will be understood by those skilled in the art, refrigeration system 460 may include additional components, e.g., at least one additional evaporator, compressor, expansion device, and/or condenser. As an example, refrigeration system 460 may include two evaporators.

Within refrigeration system 460, gaseous refrigerant flows into linear compressor 420, which operates to increase the pressure of the refrigerant. This compression of the refrigerant raises its temperature, which is lowered by passing the gaseous refrigerant through condenser 466. Within condenser 466, heat exchange with ambient air takes place so as to cool the refrigerant and cause the refrigerant to condense to a liquid state. A fan 472 is used to pull air across condenser 466, as illustrated by arrows AC, so as to provide forced convection for a more rapid and efficient heat exchange between the refrigerant within condenser 466 and the ambient air. Thus, as will be understood by those skilled in the art, increasing air flow across condenser 466 can, e.g., increase the efficiency of condenser 466 by improving cooling of the refrigerant contained therein.

An expansion device (e.g., a valve, capillary tube, or other restriction device) 468 receives liquid refrigerant from condenser 466. From expansion device 468, the liquid refrigerant enters evaporator 470. Upon exiting expansion device 468 and entering evaporator 470, the liquid refrigerant drops in pressure and vaporizes. Due to the pressure drop and phase change of the refrigerant, evaporator 470 is cool relative to compartments 12 and 14 of refrigerator appliance 10. As such, cooled air is produced and refrigerates compartments 12 and 14 of refrigerator appliance 10. Thus, evaporator 470 is a type of heat exchanger which transfers heat from air passing over evaporator 470 to refrigerant flowing through evaporator 470.

Collectively, the vapor compression cycle components in a refrigeration circuit, associated fans, and associated compartments are sometimes referred to as a sealed refrigeration system operable to force cold air through refrigeration compartments 12 and freezer compartment 14 (FIG. 2).

Also shown in FIG. 4 is a defrosting element 450. Defrosting element 540 can be periodically energized by a controller for the purpose of removing accumulated frost from the surfaces of evaporator 470. Defrosting element 450 can be any suitable element or heater for warming the surfaces of evaporator 470. For example, defrosting element 450 can be a radiant heater or other suitable form of heating element. It will be appreciated that if refrigeration system 460 contained additional evaporators in addition to evaporator 470, additional defrosting elements could be provided as well.

The refrigeration system 460 depicted in FIG. 4 is provided by way of example only. Thus, it is within the scope of the present subject matter for other configurations of the refrigeration system to be used as well.

Figure 5:
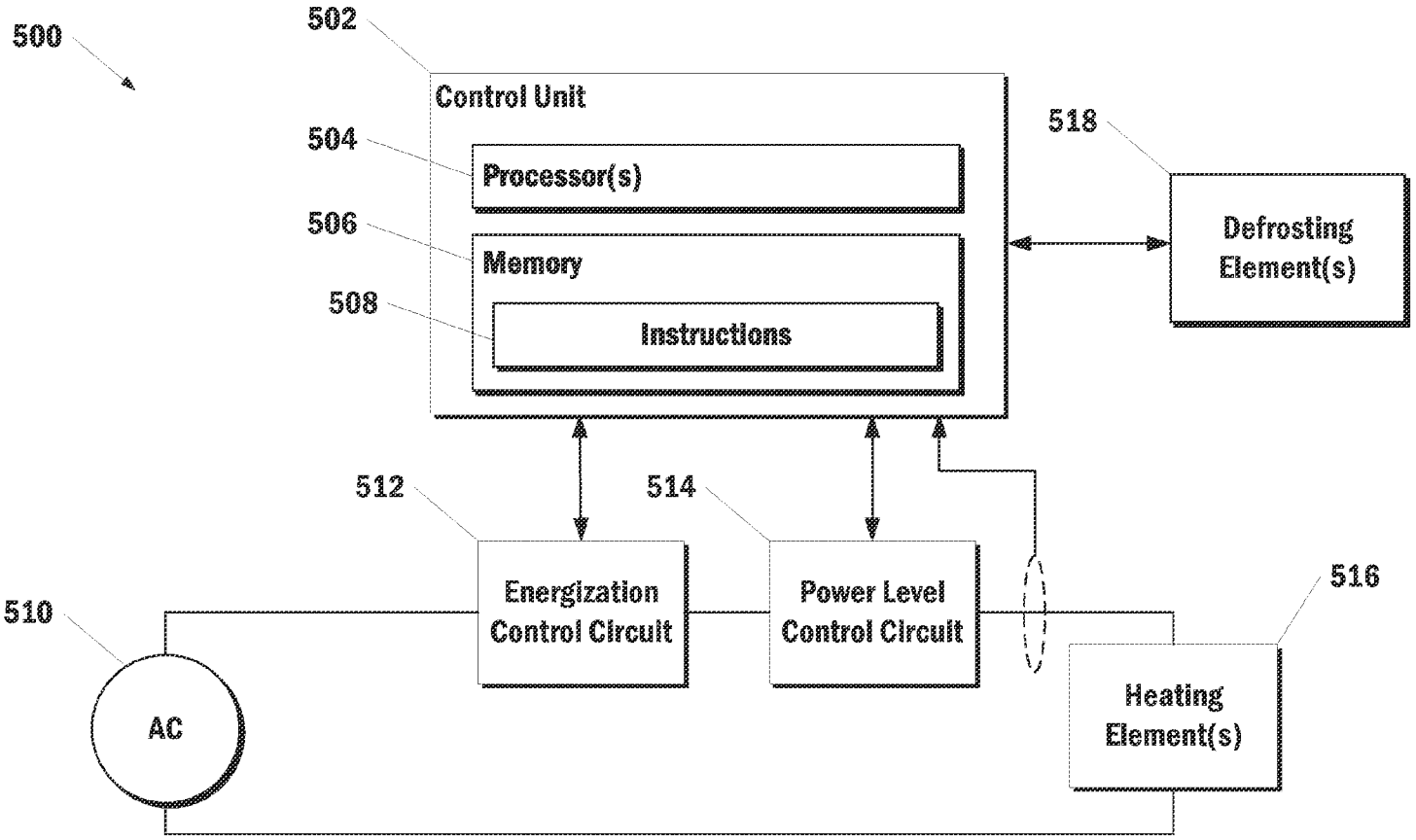
FIG. 5 depicts a block diagram view of an exemplary refrigerator control system according to an exemplary embodiment of the present disclosure.

FIG. 5 depicts a block diagram view of an exemplary refrigerator control system 500 according to an exemplary embodiment of the present disclosure. Refrigerator control system 500 can include a control unit 502, an AC connection 510, an energization control circuit 512, a power level control circuit 514, a heating element 516, and a defrosting element 518.

Control unit 502 can include one or more processor(s) 504, a memory 506, and any other suitable components. The processor(s) 504 can be any suitable processing device, such as a microprocessor, microcontroller, integrated circuit, or other suitable processing device. The memory 506 can include any suitable computing system or media, including, but not limited to, non-transitory computer-readable media, RAM, ROM, hard drives, flash drives, or other memory devices. While FIG. 5 depicts control unit 502 as a single component, it will be appreciated that processor(s) 504 and memory 506 are not required to be positioned together or within any particular distance of each other.

The memory 506 can store information accessible by processor(s) 504, including instructions 508 that can be executed by processor(s) 504. The instructions 508 can be any set of instructions that when executed by the processor(s) 504, cause the processor(s) 504 to provide desired functionality, such as implementing aspects of the present disclosure.

AC connection 510 can be any suitable components or circuitry for receiving AC power from an AC power source. For example, the AC power can be AC power generated by a utility and received via a wall socket.

Energization control circuit 512 can be any suitable components or circuitry for controlling or discontinuing flow of energy from AC connection 512 to heating element(s) 516. As an example, energization control circuit 512 can be controlled by control unit 502 and can include one or more switching elements.

Power level control circuit 514 can be any suitable components or circuitry for controlling or adjusting the level of power provided to heating element(s) 516. For example, according to aspects of the present disclosure, control unit 502 can control power level control circuit 514 to provide two different energy level settings for heating element(s) 516, such as, for example, a full power setting and a half power setting. Various exemplary implementations of power level control circuit 514 will be discussed further below.

Heating element(s) 516 can be included in a water dispensing system included in the refrigerator. For example, heating element(s) 516 can be a resistance heating element, a microwave heating element, an induction heating element, or other suitable forms of heating elements. Heating element(s) 516 can be positioned within a hot water storage tank or can be a component of an in-line heating system.

Defrosting element(s) 518 can be included in a defrosting assembly for defrosting one or more of an evaporator or a freezer compartment of the refrigerator. Defrosting element(s) 518 can be any suitable form of heating device, including a radiant heater. Control unit 502 can control the energization or operation of defrosting element(s) 518. Generally, control unit 502 can always be aware of the energization status of defrosting element(s) 518, for example, by way of signals or communications provided by various buses or circuit boards.

Figure 6:
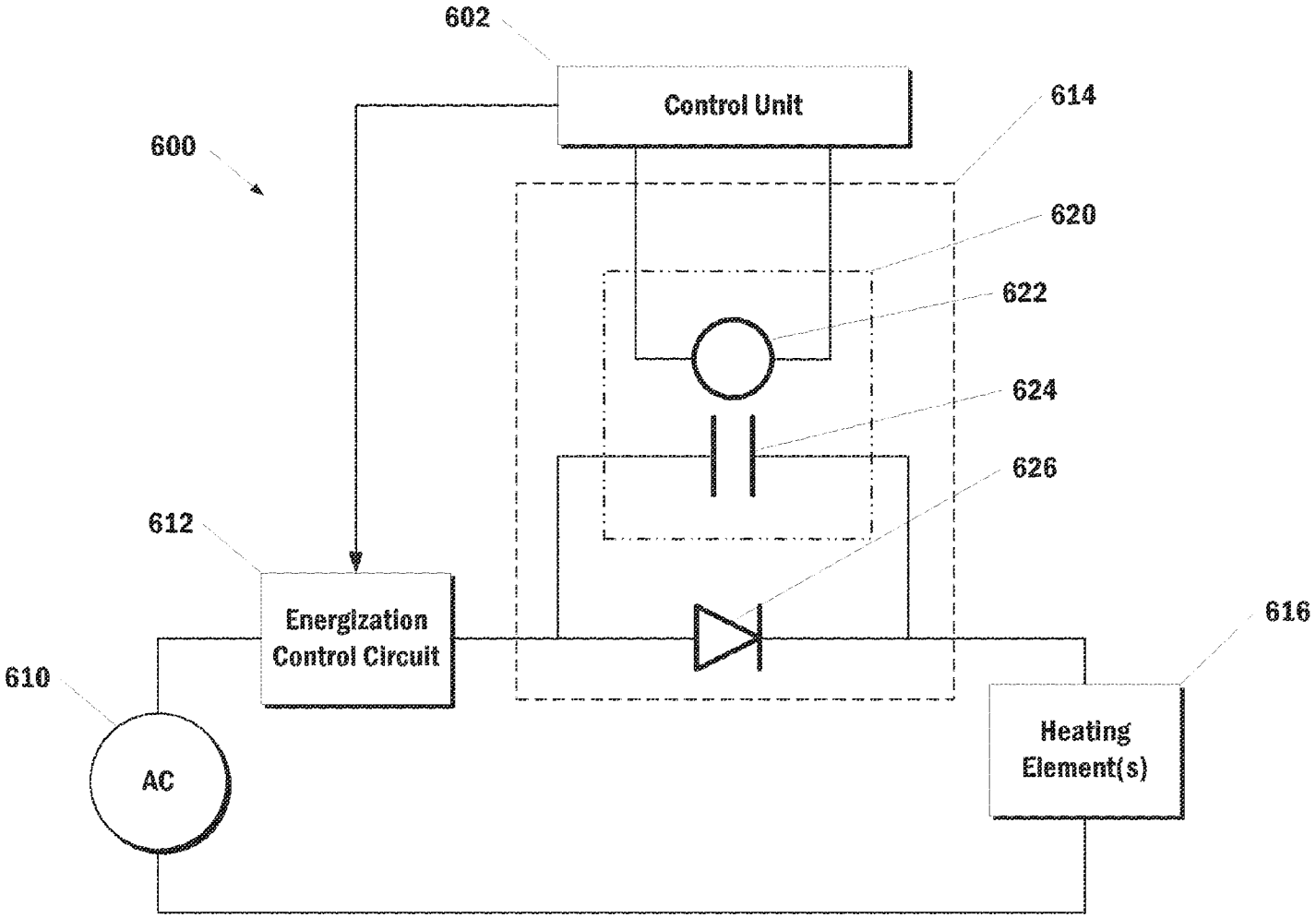
FIG. 6 depicts a schematic view of an exemplary refrigerator control system according to an exemplary embodiment of the present disclosure.

FIG. 6 depicts a schematic view of an exemplary refrigerator control system 600 according to an exemplary embodiment of the present disclosure. Control system 600 includes a control unit 602, an AC connection 610, an energization control circuit 612, an exemplary power level control circuit 614, and one or more heating element(s) 616. Heating element(s) 616 are included within a water dispensing system and can be energized to heat a volume of water.

Power level control circuit 614 can include a relay 620 and a diode 626. Relay 620 can be any suitable form of relay, including a contactor relay, a solid-state relay, a latching relay, or other suitable form of relay. Relay 620 can include a relay coil 622 and relay contacts 624. As shown in FIG. 6, relay contacts 624 can be connected in electrical parallel to diode 626. Control unit 602 can energize relay coil 622 to cause relay contacts 624 to connect to each other.

According to an aspect of the present disclosure, when a defrosting element of the refrigerator is not operating, control unit 602 can control power level control circuit 614 such that full power is provided to heating element(s) 616. As an example, in order to implement such full power setting, control unit 602 can energize relay 620 and therefore electrically short diode 626. Full wave AC power can therefore be provided from AC connection 610 to heating element(s) 616.

When the defrosting element of the refrigerator is operating, control unit 602 can control power level control circuit 614 such that reduced power is provided to heating element(s) 616. As an example, in order to implement such reduced power setting, control unit 602 can discontinue energization of relay 620. Therefore, all current flow from AC connection 610 to heating element(s) 616 will be required to pass through diode 626. As will be understood by one of skill in the art, diode 626 will operate to allow the flow of current in a first direction, but will disallow or otherwise block current flow in a second direction which is opposite to the first direction. Therefore, the AC power provided from AC connection 610 to heating element(s) 616 will be half-wave in nature, enabling the reduced power consumption setting.

The relay 620 described above is a normally-open relay in which relay contacts 624 connect to each other when relay coil 622 is energized. It will be appreciated that other forms of relays can alternatively be used. For example, a normally-closed relay can be used and control unit 602 can energize the relay coil in order to disconnect the relay contacts and provide the reduced power setting. It will also be appreciated that relay 620 can be replaced with other forms of controllable switching elements to provide a controlled, on-demand electrical short across diode 626 and, therefore, achieve a substantially similar result.

Figure 7:
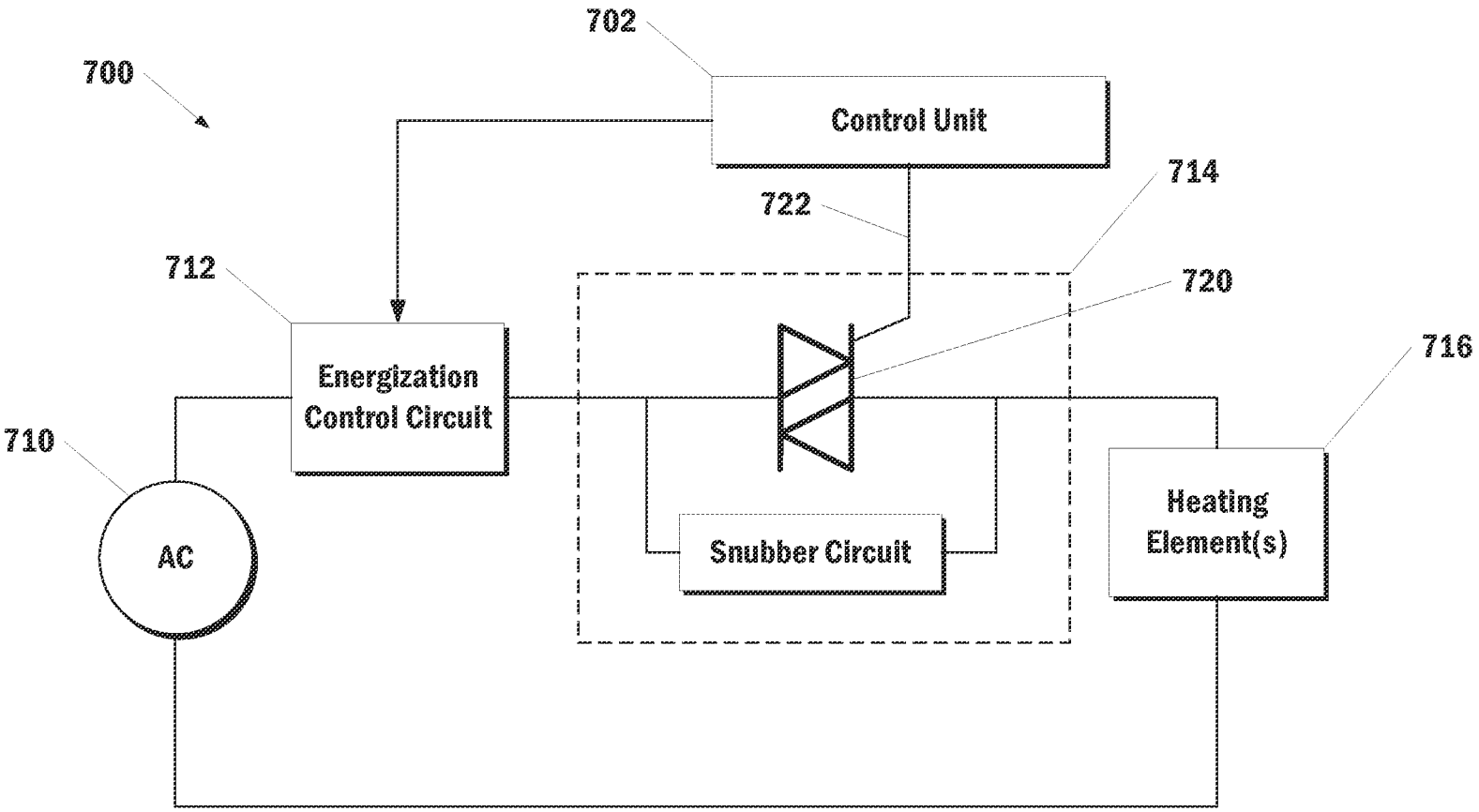
FIG. 7 depicts a schematic view of an exemplary refrigerator control system according to an exemplary embodiment of the present disclosure.

FIG. 7 depicts a schematic view of an exemplary refrigerator control system 700 according to an exemplary embodiment of the present disclosure. Control system 700 includes a control unit 702, an AC connection 710, an energization control circuit 712, an exemplary power level control circuit 714, and one or more heating element(s) 716. Heating element(s) 716 are included within a water dispensing system and can be energized to heat a volume of water.

Power level control circuit 714 can include a bidirectional triode thyristor 720. Bidirectional triode thyristor 720 can conduct current flow in both directions when triggered with a gate signal, but only conducts current flow in a single direction when not triggered with the gate signal. Power level control circuit 714 can also include a snubber circuit, as shown.

According to an aspect of the present disclosure, when a defrosting element of the refrigerator is not operating, control unit 702 can control power level control circuit 714 such that full power is provided to heating element(s) 716. As an example, in order to enable such full power setting, control unit 702 can provide a gate signal 722 to a gate of the bidirectional triode thyristor 720. Gate signal 722 can be sufficient to trigger the bidirectional triode thyristor 720 so that it conducts current in both directions. Full wave AC power can therefore be provided from AC connection 710 to heating element(s) 716.

When the defrosting element of the refrigerator is operating, control unit 702 can control power level control circuit 714 such that reduced power is provided to heating element(s) 716. As an example, in order to implement such reduced power setting, control unit can stop providing or fail to provide the gate signal 722 to bidirectional triode thyristor 720. Thus, bidirectional triode thyristor 720 will remain untriggered, conducting current only in one direction but not in the opposite direction. Therefore, the AC power provided from AC connection 710 to heating element(s) 716 will be half-wave in nature, enabling the reduced power consumption setting.

It will be appreciated that power level control circuit 714 can include additional components for enhanced operations. For example, power level control circuit 714 can further include a driver operably connected to bidirectional triode thyristor 720. The driver can receive gate signal 722 from the controller and pulse the gate of bidirectional triode thyristor 720 upon alternating zero-crossings exhibited by the AC power from AC power connection 710.

Figure 8:
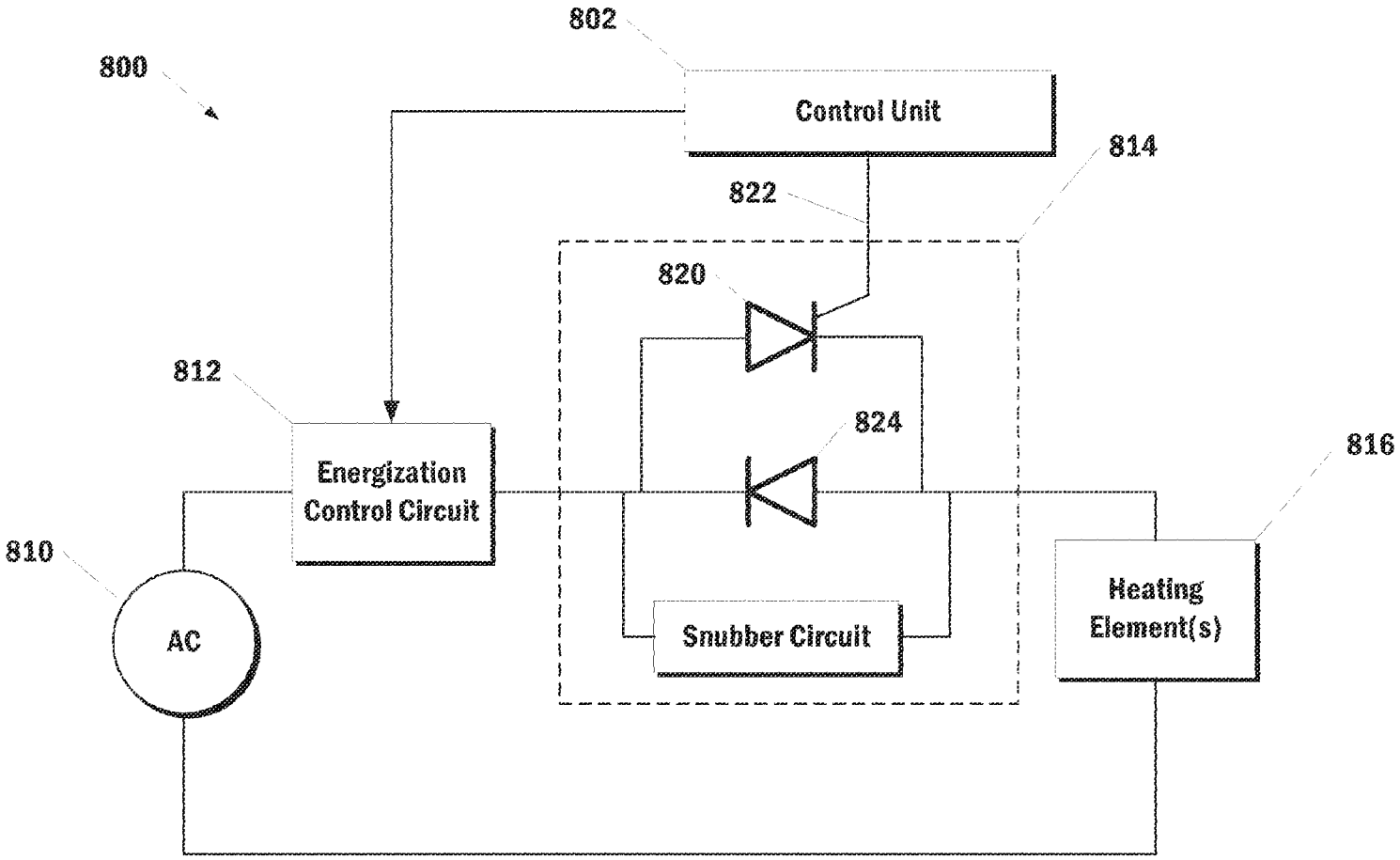
FIG. 8 depicts a schematic view of an exemplary refrigerator control system according to an exemplary embodiment of the present disclosure.

FIG. 8 depicts a schematic view of an exemplary refrigerator control system 800 according to an exemplary embodiment of the present disclosure. Control system 800 includes a control unit 802, an AC connection 810, an energization control circuit 812, an exemplary power level control circuit 814, and one or more heating element(s) 816. Heating element(s) 816 are included within a water dispensing system and can be energized to heat a volume of water.

Power level control circuit 814 can include a controllable unidirectional semiconductor device 820 connected in electrical parallel with a diode 824. Diode 824 can allow current flow in a first direction and disallow or otherwise block current flow in a second, opposite direction.

Controllable unidirectional semiconductor device 820 can be positioned so that it allows current flow in the second direction when triggered with a gate signal and blocks current flow in the first direction. Semiconductor device 820 does not conduct current in either direction when not triggered with the gate signal. Once triggered, semiconductor device 820 can continue to allow current flow so long as current through semiconductor device 820 remains above a holding current.

In one embodiment, semiconductor device 820 is a silicon-controlled rectifier or other suitable form of thyristor. Power level control circuit 814 can further include a snubber circuit, as shown.

According to an aspect of the present disclosure, when a defrosting element of the refrigerator is not operating, control unit 802 can control power level control circuit 814 such that full power is provided to heating element(s) 816. As an example, in order to enable such full power setting, control unit 802 can provide a gate signal 822 to a gate of semiconductor device 820. Gate signal 822 can be sufficient to trigger semiconductor device 820 so that it conducts current in the second direction. Thus, current can flow in the first direction through diode 824 and in the second direction through semiconductor device 820. Full wave AC power can therefore be provided from AC connection 810 to heating element(s) 816.

When the defrosting element of the refrigerator is operating, control unit 802 can control power level control circuit 814 such that reduced power is provided to heating element(s) 816. As an example, in order to implement such reduced power setting, control unit can stop providing or fail to provide the gate signal 822 to semiconductor device 820. Thus, semiconductor device 820 will remain untriggered, and will not conduct current in either direction. Therefore, the AC power provided from AC connection 810 to heating element(s) 816 will be half-wave in nature, enabling the reduced power consumption setting.

It will be appreciated that power level control circuit 814 can include additional components for enhanced operations. For example, power level control circuit 814 can further include a driver operably connected to semiconductor device 820. The driver can receive gate signal 822 from the controller and pulse the gate of semiconductor device 820 upon alternating zero-crossings exhibited by the AC power from AC power connection 810.

Figure 9:
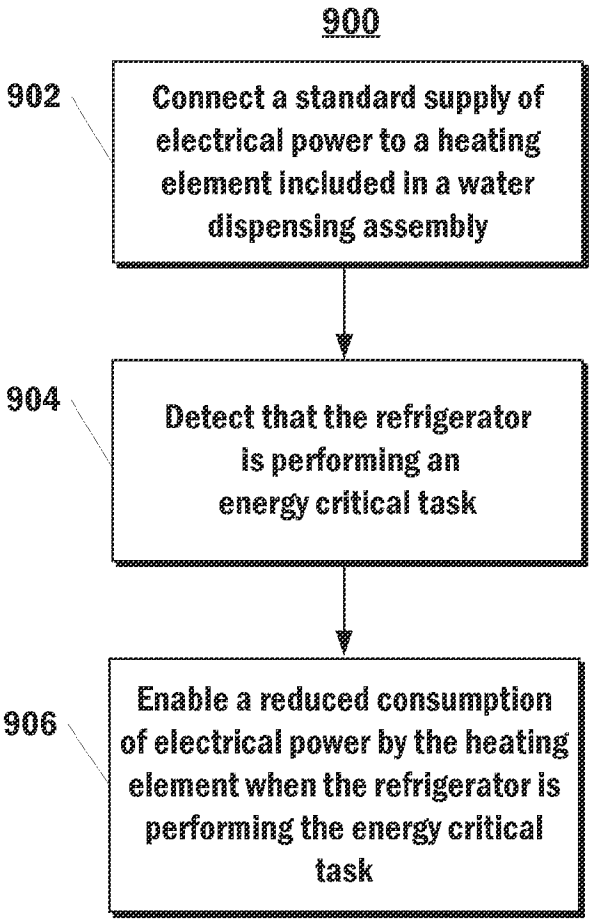
FIG. 9 depicts a flowchart of an exemplary method for operating a refrigerator according to an exemplary embodiment of the present disclosure.

FIG. 9 depicts a flowchart of an exemplary method (900) for operating a refrigerator according to an exemplary embodiment of the present disclosure. While exemplary method (900) will be discussed with reference to exemplary control system 500 of FIG. 5, method (900) can be implemented using any suitable refrigerator control system. In addition, although FIG. 9 depicts steps performed in a particular order for purposes of illustration and discussion, methods of the present disclosure are not limited to such particular order or arrangement. One skilled in the art, using the disclosures provided herein, will appreciate that various steps of the method (900) can be omitted, rearranged, combined, and/or adapted in various ways without deviating from the scope of the present disclosure.

At (902) a standard supply of electrical power can be connected to a heating element included in a water dispensing assembly. For example, control unit 502 can control energization control circuit 512 and power level control circuit 514 to enable AC power from AC connection 510 to flow to heating element(s) 516 without significant interruption or dissipation.

At (904) it can be detected that the refrigerator is performing an energy critical task. For example, control unit 502 can detect or otherwise be aware that defrosting element(s) 518 are operating to defrost an evaporator. Other energy critical tasks can be detected at (904) as well, including ice formation in an ice maker, compartment temperature reduction, or any other tasks for which a sufficient supply of energy is critical.

At (906) a reduced consumption of electrical power by the heating element can be enabled. For example, control unit 502 can control power level control circuit 514 to reduce the power supplied to heating element(s) 516 from AC connection 510. As an example, current flow from AC connection 510 to heating elements (516) can be discontinued with respect to all components except a unidirectional conductive device, such as a diode or untriggered bidirectional triode thyristor.

Figure 10:
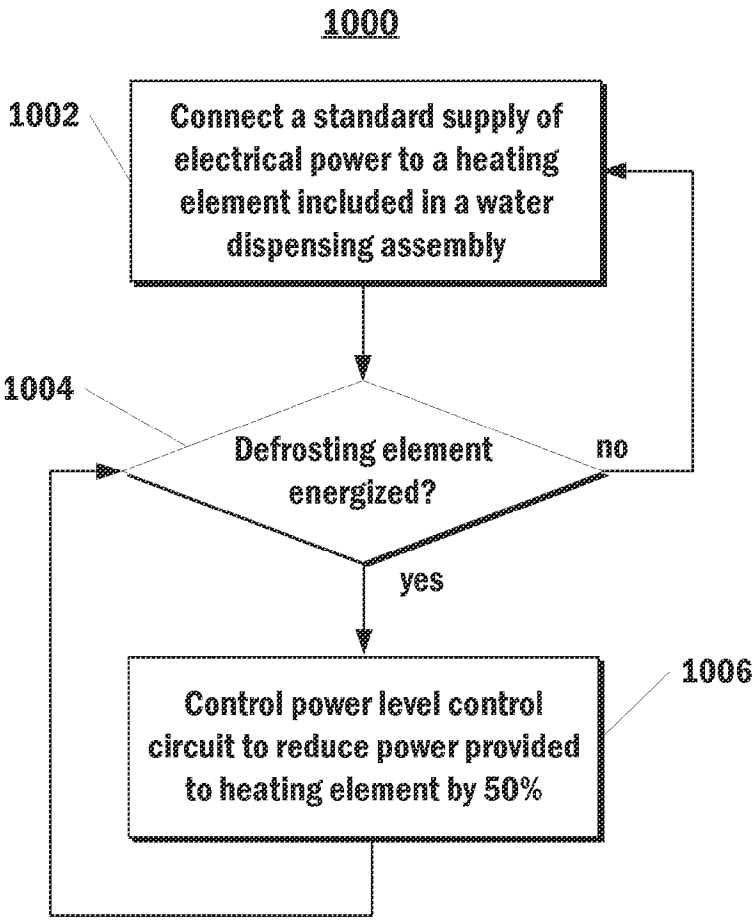
FIG. 10 depicts a flowchart of an exemplary method for operating a refrigerator according to an exemplary embodiment of the present disclosure.

FIG. 10 depicts a flowchart of an exemplary method (1000) for operating a refrigerator according to an exemplary embodiment of the present disclosure. While exemplary method (1000) will be discussed with reference to exemplary control system 500 of FIG. 5, method (1000) can be implemented using any suitable refrigerator control system. In addition, although FIG. 10 depicts steps performed in a particular order for purposes of illustration and discussion, methods of the present disclosure are not limited to such particular order or arrangement. One skilled in the art, using the disclosures provided herein, will appreciate that various steps of the method (1000) can be omitted, rearranged, combined, and/or adapted in various ways without deviating from the scope of the present disclosure.

At (1002) a standard supply of electrical power can be connected to a heating element included in a water dispensing assembly. For example, control unit 502 can control energization control circuit 512 and power level control circuit 514 to enable AC power from AC connection 510 to flow to heating element(s) 516 without significant interruption or dissipation.

At (1004) it can be determined whether a defrosting element is presently being energized. For example, control unit 502 can determine whether defrosting element(s) 518 are presently being energized.

If it is determined at (1004) that the defrosting element is not presently being energized, then method (1000) can return to (1002). However, if it is determined at (1004) that the defrosting element is presently being energized, then method (1000) can proceed to (1006).

At (1006) a power level control circuit can be controlled to reduce the power provided to the heating element by fifty percent. For example, control unit 502 can control power level control circuit 514 to reduce the power provided to heating element(s) 516 by fifty percent. Method (1000) can then return to (1004).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator, comprising:

a refrigeration system comprising an evaporator;

a defrost assembly for defrosting one or more of the evaporator or a freezer compartment;

a water dispensing assembly comprising a heating element for heating a volume of water; and a controller configured to:

receive a signal from the defrost assembly that is indicative of whether the defrost assembly is operating to defrost the one or more of the evaporator or the freezer compartment;

determine based on the received signal whether the defrost assembly is operating to defrost the one or more of the evaporator or the freezer compartment;

in response to a determination that the defrost assembly is not operating to defrost the one or more of the evaporator or the freezer compartment, operate the heating element at a first energy level; and in response to a determination that the defrost assembly is operating to defrost the one or more of the evaporator or the freezer compartment, operate the heating element at a second energy level;

wherein the second energy level is less than the first energy level.

2. The refrigerator of claim 1, wherein the first energy level comprises a full power setting and the second energy level comprises a half power setting.

3. The refrigerator of claim 2, further comprising:

circuitry for receiving power from an AC power source; and a power level control mechanism electrically connected between the power source and the heating element;

wherein the controller is configured to manipulate the power level control mechanism such that operation of the heating element can be switched between the full power setting and the half power setting.

4. The refrigerator of claim 3, wherein:

the power level control mechanism comprises:

a diode positioned in a path of current flow from the AC power source to the heating element; and a relay connected in parallel with the diode and configured to electrically short the diode when the relay is energized; and the controller is configured to energize the relay to operate the heating element at the full power setting.

5. The refrigerator of claim 4, wherein the controller is configured to discontinue energization of the relay to operate the heating element at the half power setting.

6. The refrigerator of claim 3, wherein:

the power level control mechanism comprises a bidirectional triode thyristor positioned in a path of current flow from the AC power source to the heating element; and the controller is configured to provide agate signal to the bidirectional triode thyristor to operate the heating element at the full power setting, such that both positive and negative current flows through the bidirectional triode thyristor.

7. The refrigerator of claim 6, wherein the power level control mechanism further comprises a driver operably connected to the bidirectional triode thyristor, the driver being configured to:

receive the gate signal from the controller; and when the gate signal is being received from the controller, pulse a gate of the bidirectional triode thyristor upon alternating zero-crossings exhibited by the AC power from the AC power source.

8. The refrigerator of claim 3, wherein:

the power level control mechanism comprises:

a diode positioned in a path of current flow from the AC power source to the heating element, the diode allowing current flow in a first direction and disallowing current flow in a second direction; and a semiconductor device connected in parallel with the diode, the semiconductor device disallowing current flow in the first direction, allowing current flow in the second direction when provided with a gate signal, and disallowing current flow in the second direction when not provided with the gate signal; and the controller is configured to provide the gate signal to the semiconductor device to operate the heating element at the full power setting.

9. The refrigerator of claim 8, wherein the semiconductor device comprises a thyristor.

10. The refrigerator of claim 8, wherein the semiconductor device comprises a silicon-controlled rectifier.

11. A refrigerator control circuit included in a refrigerator having a water dispensing system comprising a heating element, the refrigerator further having a defrosting element operable to defrost an evaporator of the refrigerator, the refrigerator control circuit comprising:

a control unit comprising a processor and a memory;

an AC connection for receiving AC power from an AC power supply; and a power level control circuit electrically connected between the AC connection and the heating element;

wherein the control unit:

receives a signal from the defrosting element that is indicative of whether the defrosting element is operating to defrost the evaporator of the refrigerator;

determines based on the received signal whether the defrosting element is operating to defrost the evaporator of the refrigerator;

in response to a determination that the defrosting element is not operating to defrost the evaporator of the refrigerator, controls the power level control circuit to provide a first level of power to the heating element; and in response to a determination that the defrosting element is operating to defrost the evaporator of the refrigerator, controls the power level control circuit to provide a second level of power to the heating element, the first level of power greater than the second level of power.

12. The refrigerator control circuit of claim 11, wherein the first level of power is twice the second level of power.

13. The refrigerator control circuit of claim 11, wherein the power level control circuit comprises:

a diode positioned in a path of current flow from the AC connection to the heating element; and a relay connected in parallel with the diode, the relay electrically shorting the diode when energized;

wherein the control unit energizes the relay to provide the first level of power.

14. The refrigerator control circuit of claim 11, wherein: the power level control circuit comprises a bidirectional triode thyristor positioned in a path of current flow from the AC connection to the heating element; and the control unit provides a gate signal to the bidirectional triode thyristor to provide the first level of power.

15. The refrigerator control circuit of claim 11, wherein the power level control circuit comprises:

a diode positioned in a path of current flow from the AC connection to the heating element, the diode permitting current flow in a first direction but not in a second direction, the second direction being the opposite of the first direction; and a controllable unidirectional conductor in parallel with the diode, the unidirectional conductor being positioned to block current flow in the first direction and to permit current flow in the second direction only upon application of a gate signal;

wherein the control unit applies the gate signal to the unidirectional conductor to provide the first level of power.

16. The refrigerator control circuit of claim 15, wherein the unidirectional conductor comprises a silicon controlled rectifier.

* * * * *